US010976014B1

(12) United States Patent
Zhang

(10) Patent No.: US 10,976,014 B1
(45) Date of Patent: Apr. 13, 2021

(54) FLEXIBLE OBJECT WITH DECORATIVE LIGHT

(71) Applicant: GEMMY INDUSTRIES CORPORATION, Coppell, TX (US)

(72) Inventor: Cheng-Chun Zhang, Shenzhen (CN)

(73) Assignee: Gemmy Industries Corporation, Coppell, TX (US)

( * ) Notice: Subject to any disclaimer, the term of this patent is extended or adjusted under 35 U.S.C. 154(b) by 0 days.

(21) Appl. No.: 16/773,247

(22) Filed: Jan. 27, 2020

(51) Int. Cl.
*F21S 4/22* (2016.01)
*F21S 4/10* (2016.01)
*F21Y 115/10* (2016.01)

(52) U.S. Cl.
CPC . *F21S 4/22* (2016.01); *F21S 4/10* (2016.01); *F21Y 2115/10* (2016.08)

(58) Field of Classification Search
CPC ..... F21S 4/22; F21S 4/10; F21Y 2115/10
See application file for complete search history.

(56) References Cited

U.S. PATENT DOCUMENTS 2,015,981 A * 10/1935 Welfield ..... F21S 4/10 24/115 J
3,677,867 A * 7/1972 Westlund ..... A47G 33/06 428/9
6,352,355 B1 * 3/2002 Law ..... D04D 9/04 362/234
10,859,750 B1 * 12/2020 Lai ..... G06F 3/0395
2010/0259933 A1 * 10/2010 Wang ..... F21S 4/10 362/249.06
2015/0204496 A1 * 7/2015 Cselenyi ..... F21S 4/15 362/190
2015/0204527 A1 * 7/2015 Van Os ..... F21K 9/90 362/249.08
2018/0160762 A1 * 6/2018 Sackett ..... A43B 13/04

* cited by examiner

*Primary Examiner* — Anabel Ton
(74) *Attorney, Agent, or Firm* — Muncy, Geissler, Olds & Lowe, P.C.

(57) ABSTRACT

A flexible object has a flexible body being flexible and at least one decorative light attached to the flexible body and having a light strand and multiple threads. The light strand of each one of the at least one decorative light has a cord and multiple light emission diode units. The multiple light emission diode units are electrically connected to one another in series via the cord and are arranged along the cord. The multiple threads of each one of the at least one decorative light are sewed on the flexible body to fix the light strand of the decorative light to the flexible body. The multiple threads of each one of the at least one decorative light has a first thread wavily extending along and across the cord of the light strand of the decorative light.

8 Claims, 9 Drawing Sheets

FLEXIBLE OBJECT WITH DECORATIVE LIGHT

BACKGROUND OF THE INVENTION

1. Field of the Invention

The present invention relates to a flexible object made of cloth or plastic film, such as clothes, advertising banners, or lanterns, and more particularly to a flexible object with decorative light being sewed on the flexible object by sewing machine.

2. Description of Related Art

Flexible objects such as clothes, advertising banner, or lanterns made of flexible materials such as cloth or plastic film are flexible for being made into various contours for decoration.

In order to provide decorations of patterned light, flexible and bendable light strands are further attached to the flexible materials of flexible objects to form patterns on the flexible objects.

Conventional means for attachment of the light strands and flexible materials is to manually adhere or sew the light strands onto the flexible materials of the flexible objects via hot melt adhesive or threads.

However, the flexible and bendable light strands are hard to be fixed to the flexible materials and manufacturers have to manually adjust positions and curvature of the flexible and bendable light strands. The flexible objects are hard to be produced and the light strands are difficult to be accurately arranged on the flexible materials to form patterns.

To overcome the shortcomings of the conventional means to attach the light strands and the flexible materials, the present invention provides a flexible object with decorative light to mitigate or obviate the aforementioned problems.

SUMMARY OF THE INVENTION

The main objective of the present invention is to provide a flexible object that facilitates ease in production.

A flexible object with decorative light comprises a flexible body being flexible and at least one decorative light attached to the flexible body and having a light strand and multiple threads. The light strand of each one of the at least one decorative light has a cord and multiple light emission diode units. The multiple light emission diode units are electrically connected to one another in series via the cord and are arranged along the cord. The multiple threads of each one of the at least one decorative light are sewed on the flexible body to fix the light strand of the decorative light to the flexible body. The multiple threads of each one of the at least one decorative light has a first thread wavily extending along and across the cord of the light strand of the decorative light.

Other objects, advantages, and novel features of the invention will become more apparent from the following detailed description when taken in conjunction with the accompanying drawings.

DETAILED DESCRIPTION OF PREFERRED EMBODIMENTS

Figure 1:
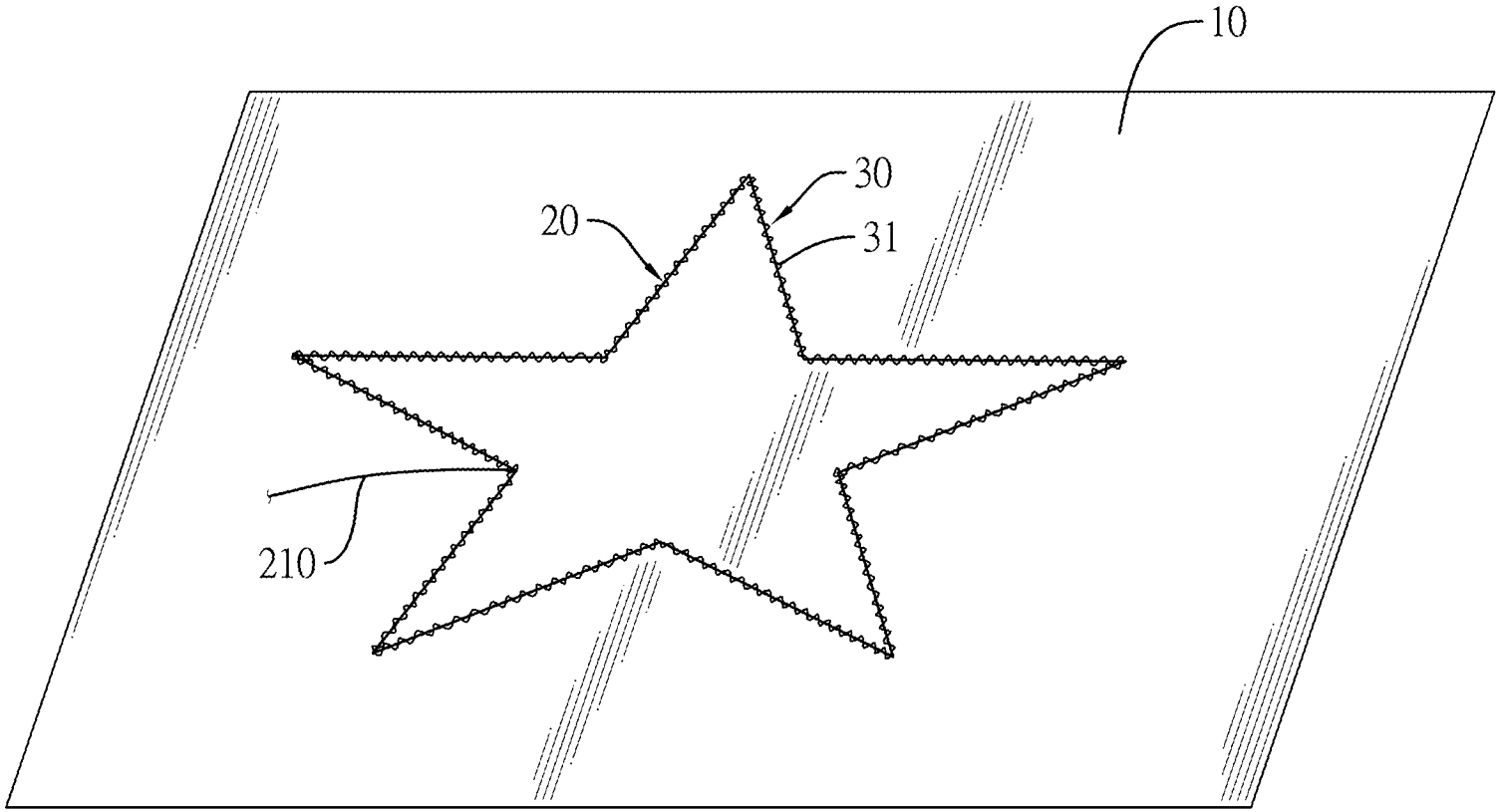
FIG. 1 is a perspective view of a first embodiment of a flexible object with decorative light in accordance with the present invention.
Figure 5:
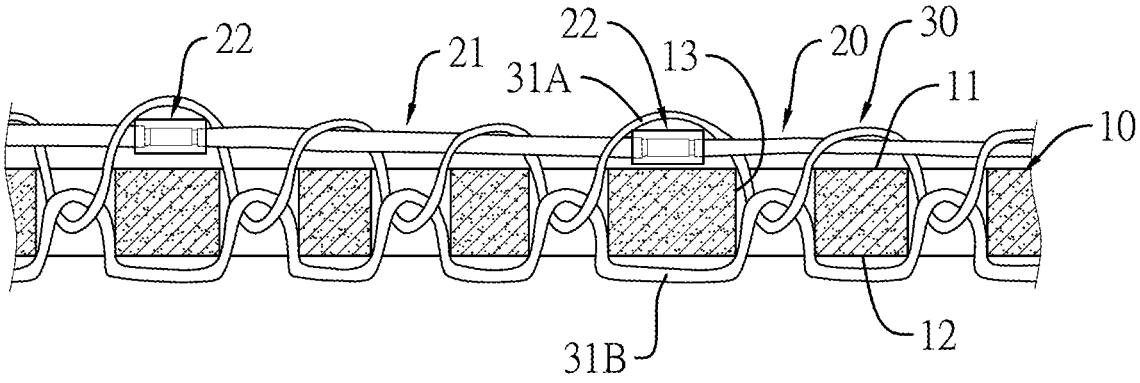
FIG. 5 is a side view in partial section of the first embodiment in FIG. 1.

With reference to FIG. 1, a first embodiment of a flexible object with decorative light in accordance with the present invention has a flexible body 10 and a decorative light. In the first embodiment, the flexible body 10 is a cloth. The flexible body 10 may be a plastic film or other flexible film being bendable. The flexible body 10 may be made of transparent materials, translucent materials, or opaque materials. With reference to FIG. 5, the flexible body 10 has a first surface 11 and a second surface 12 facing to opposite directions. The first surface 11 of the flexible body 10 faces to an outside of the flexible body 10. The second surface 12 of the flexible body 10 faces to an inside of the flexible body 10. In the first embodiment, there is one said decorative light. Practically, the decorative light may be implemented as at least one decorative light.

Figure 2:
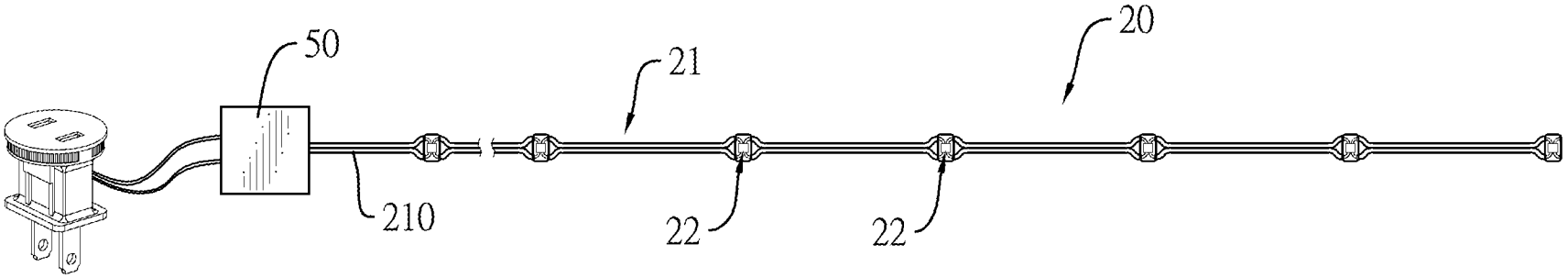
FIG. 2 is a perspective view of a light strand and a control box of a decorative light in FIG. 1.
Figure 3:
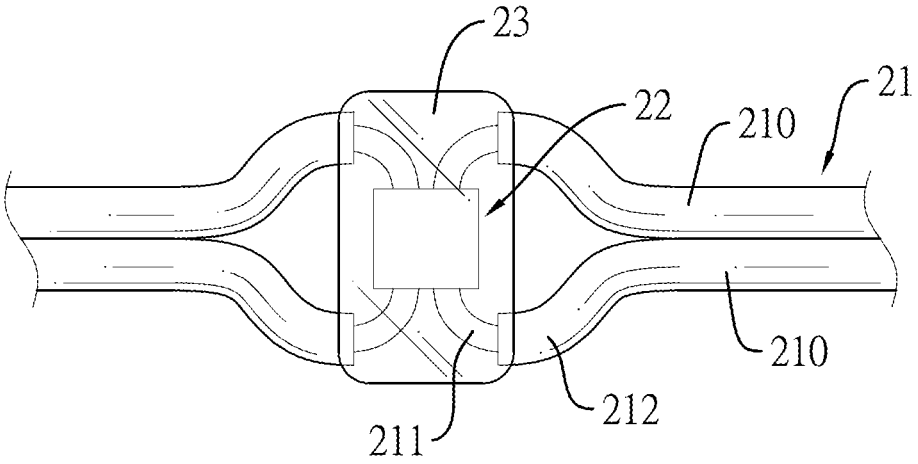
FIG. 3 is a partially enlarged top view of the light strand in FIG. 2.

With reference to FIGS. 2 and 3, the decorative light has a light strand 20 and a sewing structure 30. The light strand 20 is disposed on the first surface 11 of the flexible body 10 and is arranged to form a certain pattern. When the flexible body 10 is made of transparent or translucent materials, the light strand 20 may be disposed on the second surface 12 of the flexible body 10. The light strand 20 has a cord 21, multiple light emission diode units 22, and multiple transparent colloids 23. The multiple light emission diode units 22 are electrically connected to one another in series via the cord 21. The multiple light emission diode units 22 are arranged along the cord 21 at intervals according to the pattern and desired emission effects.

Figure 10:
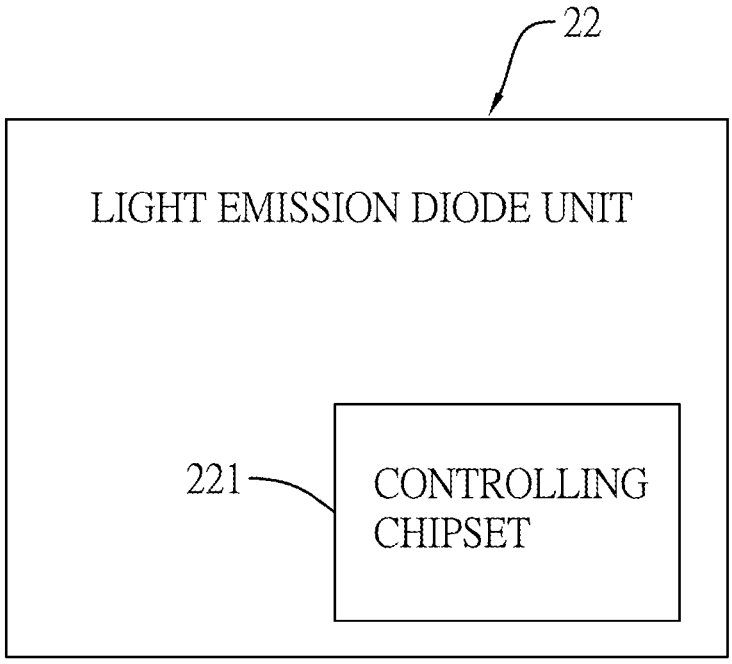
FIG. 10 is a block diagram of a light emission diode unit in FIG. 2 and shows the light emission diode unit having a chipset.

With reference to FIGS. 2 and 3, each light emission diode unit 22 may be a light emission diode unit 22 capable of emitting light in one single color or may be a light emission diode unit 22 capable of emitting light in multiple colors. With reference to FIG. 10, the light emission diode unit 22 emitting light in multiple colors may further have a controlling chipset 221 for controlling timing of emission and color of light.

With reference to FIGS. 2 and 3, the light strand 20 may be a light strand 20 with copper wires or any other light strands with similar function. The cord 21 of the light strand 20 of each decorative light has two conductors 210. Each one of the conductors 210 has an insulation 212 and a copper wire 211 wrapped in the insulation 212 having conductive sections exposed outside of the insulation 212. The conductor 210 is flexible and is bendable. Each one of the light emission diode units 22 is electrically connected to the conductive sections of the copper wires 211 of the two conductors 210. The multiple transparent colloids respectively encapsulate the multiple light emission diode units 22 and conductive sections electrically connected to the multiple light emission diode units 22.

Figure 4:
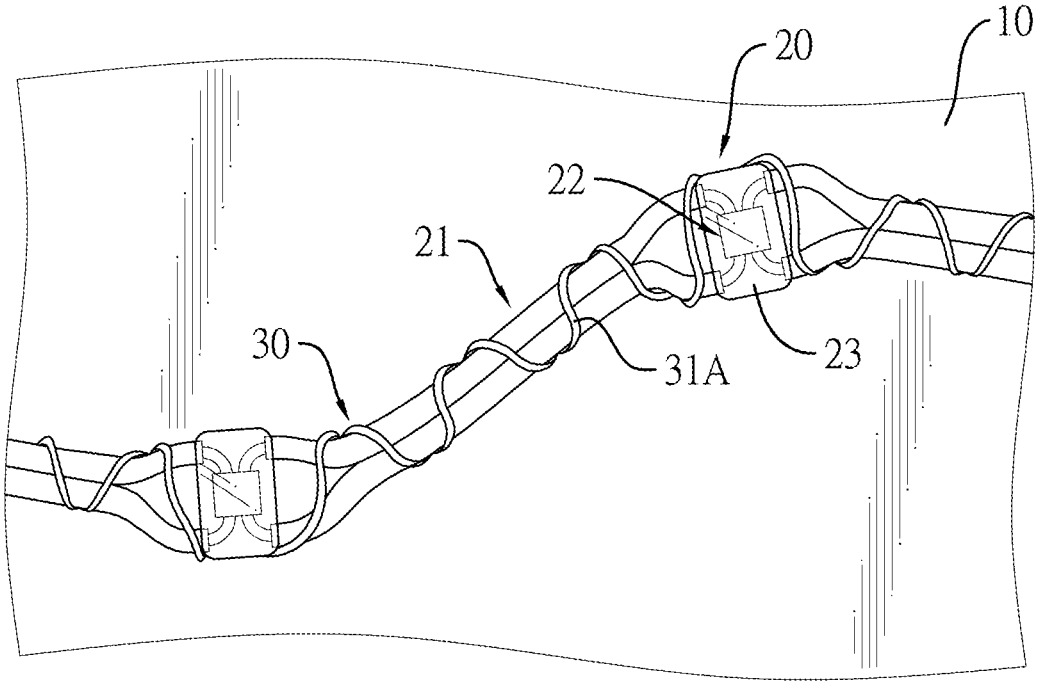
FIG. 4 is a partially enlarged top view of the first embodiment in FIG. 1.

With reference to FIGS. 1, 4, and 5, the sewing structure 30 of each decorative light connects the light strand 20 of the decorative light and the flexible body 10 by sewing. With reference to FIG. 1, the light strand 20 is arranged into a pattern of a pentagram. The light strand 20 may be optionally arranged into any other patterns, besides the pentagram. The patterns can be determined according to designations. The sewing structure 30 has multiple threads 31 and connects the light strand 20 and the flexible body 10 via the multiple threads 31.

With reference to FIGS. 4 and 5, the multiple threads 31 of the sewing structure 30 of each decorative light are two threads being a first thread 31A and a second thread 31B. The first thread 31A is disposed on the first surface 11 of the flexible body 10. The first thread 31A wavily extends along and across the cord 21 of the light strand 20. The second thread 31B is disposed on the second surface 12 of the flexible body 10. With reference to FIG. 4, the flexible body 10 has multiple needle holes 13 formed by a needle of a sewing machine and defined through the first surface 11 and the second surface 12 of the flexible body 10. The first thread 31A and the second thread 31B are intertwined in the multiple needle holes 13 in the flexible body 10.

With reference to FIGS. 4 and 5, the sewing structure 30 of the decorative light connects the light strand 20 of the decorative light to the flexible body 10 via sewing the light strand 20 by the first thread 31A and the second thread 31B, and the light strand 20 is arranged to form a pattern.

With reference to FIG. 2, a control box 50 is electrically connected to the light strand 20 and the power supply. A controlling program is stored in the control box 50 for controlling the light strand 20. Therefore, the multiple emission diode units 22 may be illuminated selectively or partially. And the light strand 20 controlled by the control box 50 produces static or dynamic visual effects.

Figure 6:
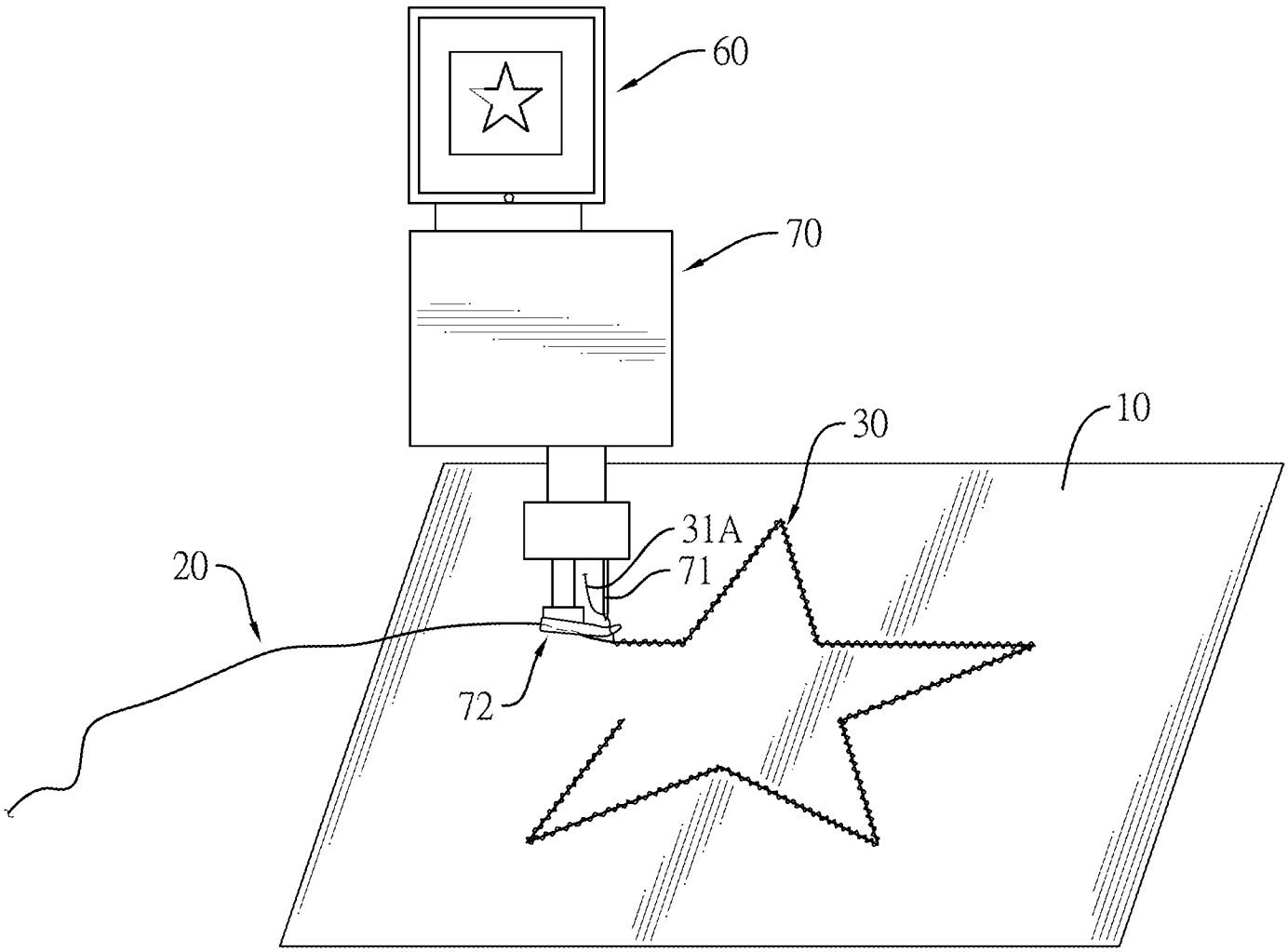
FIG. 6 is an operational perspective view showing the first embodiment being produced by a sewing machine controlled by a computer.
Figure 7:
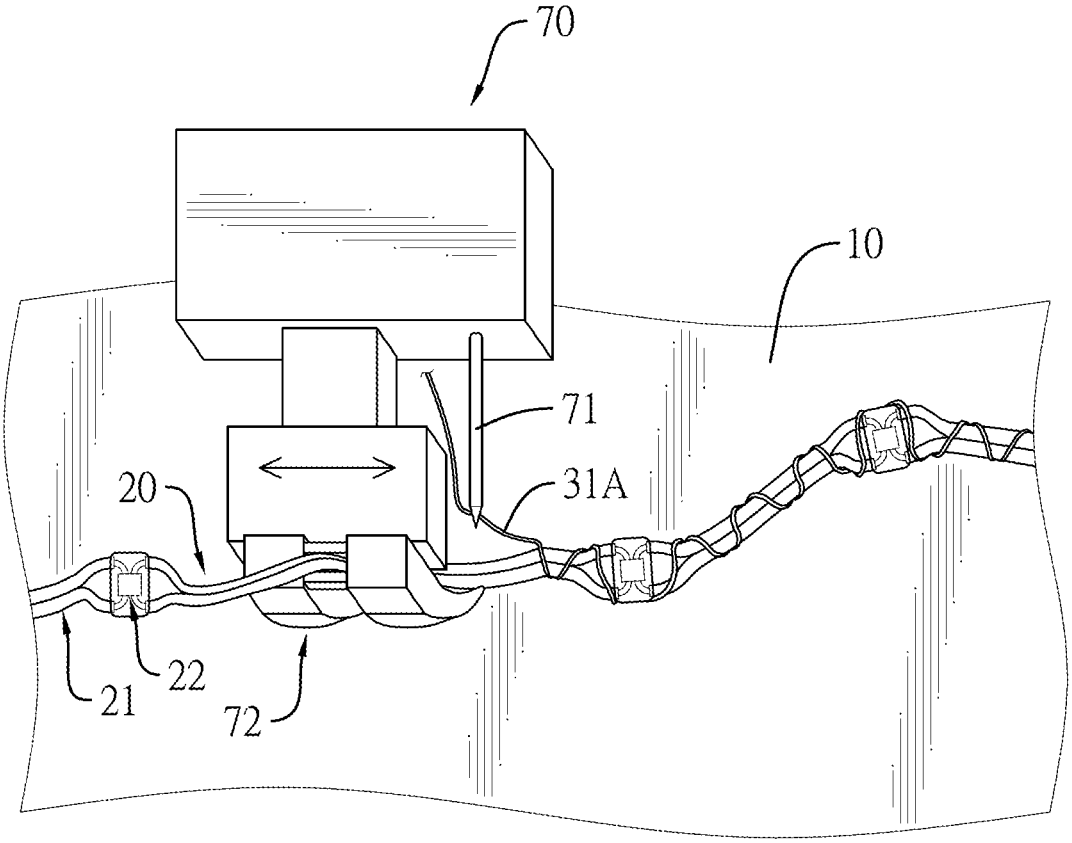
FIG. 7 is a partially enlarged perspective view of the first embodiment and the sewing machine in FIG. 6.

With reference to FIGS. 6 and 7, a designed pattern may be transferred to a program by a computer 60, and the program is stored in the computer 60. In FIGS. 6 and 7, a sewing machine 70 is specialized and designed to produce the flexible object with decorative light in accordance with the present invention and is controlled by the computer 60. The sewing machine 70 has a sewing needle 71 and a feed dog 72. The first thread 31A is inserted in the sewing needle 71. The feed dog 72 is swingable. In FIGS. 6 and 7, the light strand 20 is mounted to the feed dog 72, and the flexible body 10 is positioned below the feed dog 72. The sewing needle 71 is controlled by the program stored in the computer 60, pierces the flexible body 10 at a frequency, and sews the flexible body 10 along the designed pattern. The feed dog 72 swings according to the frequency to evade the sewing needle 71 piercing the flexible body 10. The light strand 20 swings with the feed dog 72, thereby avoiding being pierced by the sewing needle 71.

With reference to FIGS. 6 and 7, when the light strand 20 swings with the swingable feed dog 72 to evade the sewing needle 71 piercing the flexible body 10, the first thread 31A wavily extends across the cord 21 of the light strand 20 accordingly. Consequently, the light strand 20 is fixed to the flexible body 10 by the first thread 31A and the second thread 31B of the sewing structure 30.

Figure 8:
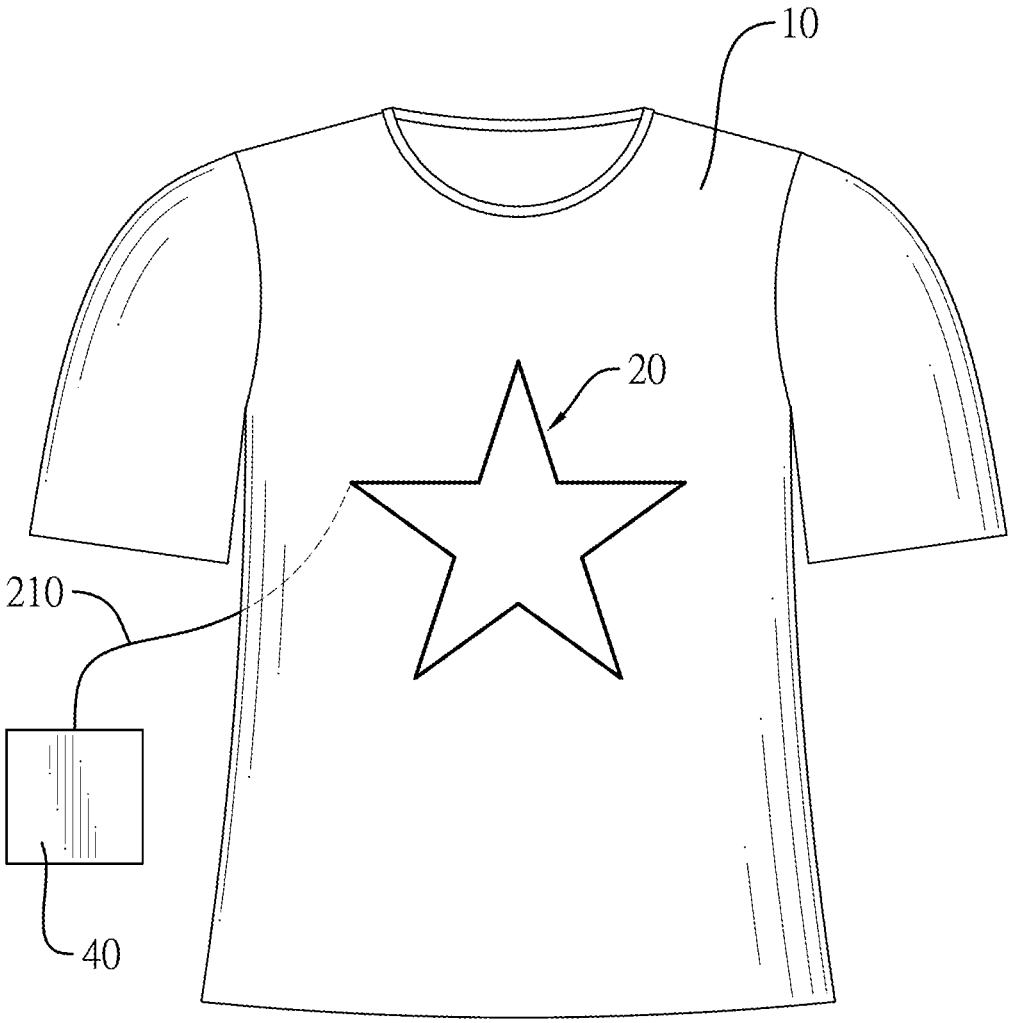
FIG. 8 is a perspective view of a second embodiment of the flexible object with decorative light in accordance with the present invention and shows a flexible body being an article of clothing.
Figure 9:
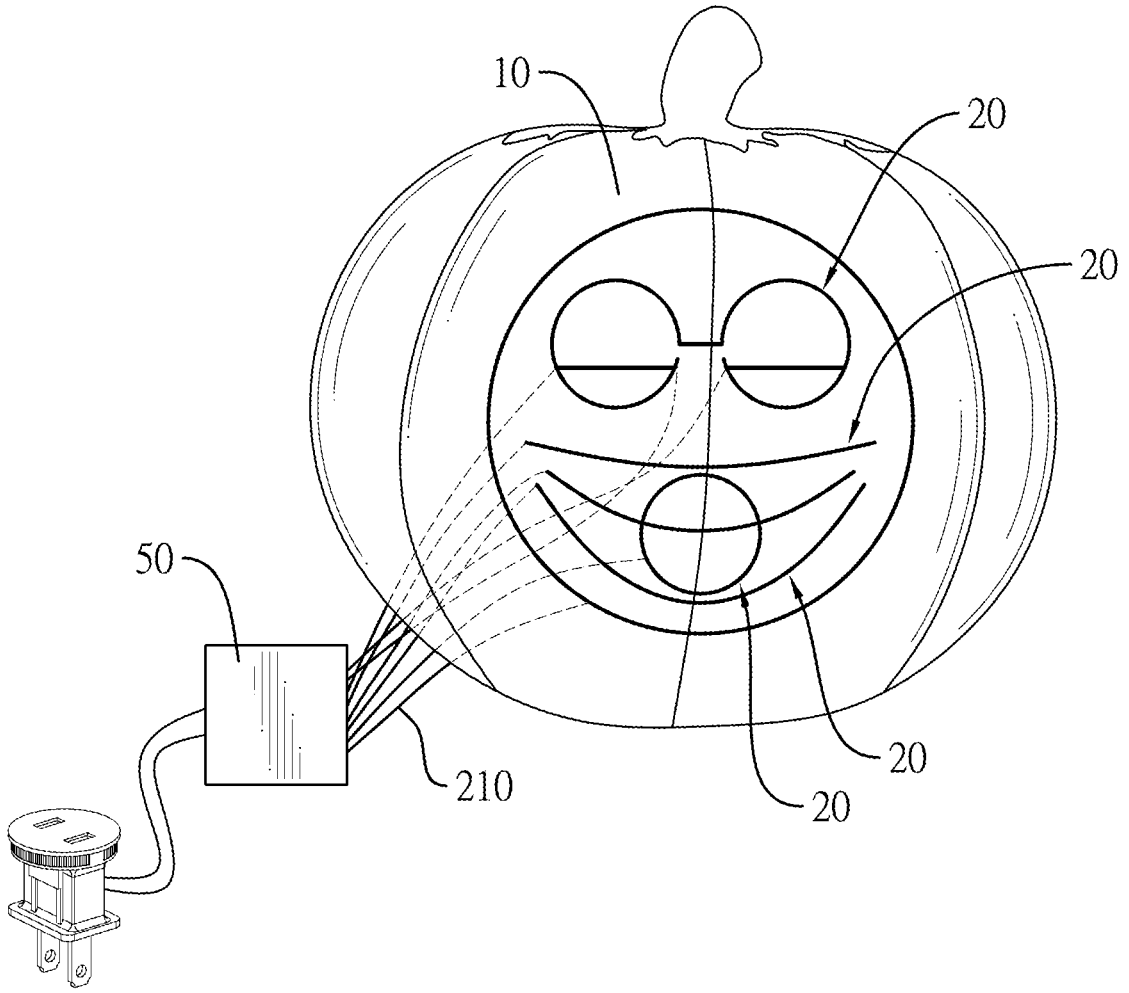
FIG. 9 is a perspective view of a third embodiment of the flexible object with decorative light in accordance with the present invention and shows the flexible body being a lantern.

The flexible body 10 may be an article of clothing, an advertising banner, or a lantern. With reference to FIG. 8, a second embodiment of the flexible object with decorative light in accordance with the present invention has a flexible body 10 being implemented as an article of clothing. In the second embodiment, a decorative light attached to the flexible body 10 may further have a portable charger 40 for power supply. With reference to FIG. 9, a third embodiment of the flexible object with decorative light in accordance with the present invention has a flexible body 10 being implemented as a lantern, and a light strand 20 in the third embodiment is arranged to form a face pattern. With reference to FIGS. 1, 8, and 9, the light strand 20 of each decorative light can be mounted through the flexible body 10, disposed on the second surface 12 of the flexible body 10, and disposed inside the flexible body 10 being the article of clothing. Or the light strand 20 may be disposed on the first surface 11 of the flexible body 10 and disposed outside the flexible body 10 as well.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A flexible object comprising:

a flexible body being flexible; and at least one decorative light attached to the flexible body, and each one of the at least one decorative light having a light strand having a cord; and multiple light emission diode units electrically connected to one another in series via the cord and arranged along the cord; and multiple threads sewed on the flexible body to fix the light strand to the flexible body and having a first thread wavily extending along and across the cord.

2. The flexible object as claimed in claim 1, wherein the flexible body has a first surface and a second surface facing to opposite directions; and multiple needle holes defined through the first surface and the second surface;

the first thread of the multiple threads of each one of the at least one decorative light is disposed on the first surface of the flexible body;

the multiple threads of each one of the at least one decorative light include a second thread disposed on the second surface of the flexible body;

the first thread and the second thread of the multiple threads of each one of the at least one decorative light are intertwined in the multiple needle holes.

3. The flexible object as claimed in claim 1, wherein the cord of the light strand of each one of the at least one decorative light has two connectors;

each one of the two connectors of the light strand of each one of the at least one decorative light has an insulation; and a copper wire wrapped in the insulation and having conductive sections exposed on an outside of the insulation and electrically connected to the multiple light emission diode units of the light strand; and the light strand of each one of the at least one decorative light has multiple transparent colloids respectively encapsulating the multiple light emission diode units of the light strand and the conductive sections electrically connected to the multiple light emission diode units.

4. The flexible object as claimed in claim 3, wherein each one of the multiple light emission diode units is a light emission diode unit being capable of emitting light in multiple colors and further having a controlling chipset for controlling timing of emission and color of light emitted from the light emission diode unit.

5. The flexible object as claimed in claim 2, wherein the cord of the light strand of each one of the at least one decorative light has two connectors;

each one of the two connectors of the light strand of each one of the at least one decorative light has an insulation; and a copper wire wrapped in the insulation and having conductive sections exposed on an outside of the insulation and electrically connected to the multiple light emission diode units of the light strand; and the light strand of each one of the at least one decorative light has multiple transparent colloids respectively encapsulating the multiple light emission diode units of the light strand and the conductive sections electrically connected to the multiple light emission diode units.

6. The flexible object as claimed in claim 5, wherein each one of the multiple light emission diode units is a light emission diode unit being capable of emitting light in multiple colors and further having a controlling chipset for controlling timing of emission and color of light emitted from the light emission diode unit.

7. The flexible object as claimed in claim 1, wherein the flexible body is made of cloth or plastic film.

8. The flexible object as claimed in claim 2, wherein the flexible body is made of cloth or plastic film.

* * * * *